US012077940B2

(12) United States Patent
Tsuneyoshi et al.

(10) Patent No.: US 12,077,940 B2
(45) Date of Patent: Sep. 3, 2024

(54) SYSTEMS, ASSEMBLIES, AND METHODS FOR IMPLEMENTING KEY PLATE FOR LOCKING CAB TO MAIN BODY OF WORK MACHINE

(71) Applicant: Caterpillar SARL, Geneva (CH)

(72) Inventors: Takeshi Tsuneyoshi, Akashi (JP); Kunitomo Shimizu, Akashi (JP); Kazumasa Matsumura, Akashi (JP); Shuji Kidoguchi, Akashi (JP)

(73) Assignee: Caterpillar SARL, Geneva (CH)

( * ) Notice: Subject to any disclaimer, the term of this patent is extended or adjusted under 35 U.S.C. 154(b) by 424 days.

(21) Appl. No.: 17/472,703

(22) Filed: Sep. 13, 2021

(65) Prior Publication Data

US 2023/0079417 A1 Mar. 16, 2023

(51) Int. Cl.

| | |
|---|---|
| ***E02F 9/16*** | (2006.01) |
| ***B62D 33/063*** | (2006.01) |
| ***B62D 33/067*** | (2006.01) |
| ***B62D 33/07*** | (2006.01) |

(52) U.S. Cl.
CPC ..... *E02F 9/166* (2013.01)

(58) Field of Classification Search
CPC ..... E02F 9/0808; E02F 9/166; B62D 33/063; B62D 33/067; B62D 33/07
See application file for complete search history.

(56) References Cited

U.S. PATENT DOCUMENTS 3,428,343 A * 2/1969 Downie ..... F16D 1/0882 403/358
4,012,071 A * 3/1977 Jones ..... B62D 33/0604 296/35.1
4,053,178 A * 10/1977 York ..... E02F 9/166 296/35.1
5,024,283 A * 6/1991 Deli ..... F16F 1/38 296/190.07
5,784,813 A * 7/1998 Balassa ..... E02F 9/2825 37/457
5,918,694 A * 7/1999 Miller ..... E02F 9/2004 180/328
5,941,330 A * 8/1999 Miller ..... E02F 9/166 180/328

(Continued)

FOREIGN PATENT DOCUMENTS

CN 101553629 A * 10/2009 ..... E02F 9/166
CN 111074963 A * 4/2020

(Continued)

*Primary Examiner* — Barry Gooden, Jr.

(57) ABSTRACT

A work machine comprising a main body and a cab riser. The cab riser includes a cab and a frame comprising a first plate to contact a second plate provided on the main body in a first position which the cab is uprightly positioned on the work machine. The first and the second plate are coupled together to sandwich a key plate in the first position, the key plate being disposed in a space created by a first recess on a lower surface of the first plate and a second recess on an upper surface of the second plate, the second recess being aligned with the first recess vertically in the first position, and the key plate includes a first contact surface as a slope surface and a top surface being adjacent to the slope surface in the cross sectional view of the key plate.

20 Claims, 18 Drawing Sheets

(56) References Cited

U.S. PATENT DOCUMENTS

| | | | | | |
|---|---|---|---|---|---|
| 5,992,063 | A * | 11/1999 | Mack | E02F 9/2833 | 37/456 |
| 7,950,729 | B2 * | 5/2011 | Gerke | B62D 65/04 | 296/193.07 |
| 8,393,097 | B2 * | 3/2013 | Harder | E02F 9/2841 | 37/455 |
| 9,096,280 | B2 | 8/2015 | Sintek et al. | | |
| 9,897,158 | B2 * | 2/2018 | Ellen | F16F 1/36 | |
| 2002/0037211 | A1 * | 3/2002 | Korycan | E02F 9/2275 | 414/501 |
| 2013/0149095 | A1 * | 6/2013 | Huissoon | E02F 3/325 | 180/53.1 |
| 2017/0314229 | A1 * | 11/2017 | Capraro | E02F 9/16 | |
| 2018/0003254 | A1 * | 1/2018 | Ellen | E02F 9/166 | |
| 2018/0216737 | A1 * | 8/2018 | Hellholm | F16J 15/021 | |
| 2018/0251159 | A1 * | 9/2018 | Hellholm | B62D 21/18 | |
| 2020/0317485 | A1 * | 10/2020 | Confer | B66F 9/07554 | |
| 2022/0325505 | A1 * | 10/2022 | Johnston | E02F 9/2858 | |
| 2023/0081006 | A1 * | 3/2023 | Takaoka | B62D 27/065 | 180/6.64 |

FOREIGN PATENT DOCUMENTS

| | | | | | |
|---|---|---|---|---|---|
| EP | 2030874 | A2 * | 3/2009 | B62D 33/06 | |
| GB | 2545184 | A * | 6/2017 | E02F 9/0808 | |
| JP | 09310375 | A * | 12/1997 | | |
| JP | 2019-1562 | A | 1/2019 | | |
| JP | 2020-26198 | A | 2/2020 | | |
| WO | WO-2016066179 | A1 * | 5/2016 | B62D 33/0633 | |
| WO | WO-2018188805 | A1 * | 10/2018 | E02F 9/16 | |

* cited by examiner

SYSTEMS, ASSEMBLIES, AND METHODS FOR IMPLEMENTING KEY PLATE FOR LOCKING CAB TO MAIN BODY OF WORK MACHINE

TECHNICAL FIELD

The present disclosure relates to work machines, and more particularly to work machines having a cab and a cab riser which is tiltably coupled to a main body, and systems, assemblies, and methods thereof.

BACKGROUND

In work machines, such as forestry work machines, an operator's cab can be provided at a relatively high position in order to improve visibility of the work machines. On the other hand, when transporting the machine, for instance, on a transport trailer, it may be necessary to follow a transportation regulation and to prevent the operator's cab from exceeding the transportation regulation height. Thus, a cab riser can be provided to be tilted on the main body, forward around a shaft provided in front of the work machine. In an operation position, the cab riser and the cab can be raised upright by tilting them backward, while the cab riser and the cab can be laid down by tilting them forward to the work machine in a transportation position.

For secure operation of the work machine, it may be desirable for the bottom of the rear end of the cab riser to be fastened to a connecting portion to the main body correctly and firmly in the operation position. Specifically, accurate positioning of the connecting portion though the transition of the work machine from the transportation position to the operation position may be desirable.

JP2019-001562 ("the JP '562 publication") describes a system to provide a lamination type counterweight mounted on a work machine, which includes a plurality of weights stacked in the vertical direction. Part of or the entire upper surface of each of the weights is a convex (or concave) upper side tapered surface inclining with respect to the horizontal direction, and part of or the entire lower surface of each of the weights is a concave (or convex) lower side tapered surface inclining with respect to the horizontal direction and fitted in the upper side tapered surface of one of the weights stacked one layer below. According to the JP '562 publication, by having substantially quadrangular pyramid shape on the upper tapered surface and the lower tapered surface, when the upper weight is lowered onto the lower weight using a crane or the like, the upper weight can be lowered onto the lower weight by rough positioning in the horizontal direction of the upper weight with respect to the lower weight, since the upper tapered surface and the lower tapered surface become a guide, and the weights can be in a predetermined fitting state automatically by gravity.

Also, JP2020-026198 ("the JP '198 publication") describes a system to attach an additional counterweight to a work machine, which includes a fitting recess with a truncated cone shape that guides positioning of the additional counterweight on a lower standard counterweight having a protrusion corresponding to the fitting recess. Furthermore, according to the JP '198 publication, the additional counterweight can include an insert nut to fasten the additional counterweight to the lower standard counterweight by inserting a fixing bolt to the insert nut.

Generally, the products having the relatively complicated shape of protrusions, such as the two-sided quadrangular pyramid shape and the truncated cone shape, can be made by casting. However, to adopt such relatively complicated shape to a structure requiring strength to secure safety of a work machine, the protrusions may be formed so as to cause low material yield. Therefore, it has been desired to facilitate accurate positioning of parts of the cab riser and the main body of the work machine by guide during transition of the work machine from the transportation position to the operation position, while improving the material yield.

Also, when the parts of the cab riser and the main body of the work machine are merely fixed by a fastening member (e.g., a bolt and a nut, or a screw), the fastening member may be broken by a shearing force that acts on the fastening member in case a contact surface of the parts slides laterally. Accordingly, it has been desired to provide a structure which prevents or minimizes the shearing force from applying to the fastening member, in addition to facilitating positioning of parts of the cab riser and the main body of the work machine by guide during transition of the work machine from the transportation position to the operation position, while improving the material yield.

SUMMARY

According to an aspect a work machine is described or provided. The work machine can comprise a main body and a cab riser. The cab riser can include a cab and a frame, the cab being uprightly positioned on the work machine in a first position, and being tilted forward in a second position, and the frame comprising a first plate to contact a second plate provided on the main body in the first position. The first plate and the second plate can be coupled together to sandwich a key plate when the cab is in the first position, the key plate being disposed in a space created by a first recess on a lower surface of the first plate and a second recess on an upper surface of the second plate in a cross sectional view of the first plate and the second plate, the second recess being aligned with the first recess vertically when the cab is in the first position, and the key plate can include at least one first contact surface as a slope surface and at least one top surface, the top surface being adjacent to the slope surface and substantially in parallel with the first plate or the second plate in a vertical direction, in the cross sectional view of the key plate.

In another aspect, a method is disclosed or implemented. The method can comprise providing a key plate for a work machine, the key plate having at least one top surface and at least one first contact surface as a slope surface in a cross sectional view of the key plate; and providing the key plate between a first plate and a second plate of the work machine, the first plate being a part of a cab riser of the work machine, the second plate being a part of a main body of the work machine, and the first plate being mounted on the second plate in a vertical direction. The key plate can be disposed in a space created by a first recess on a lower surface of the first plate and a second recess on an upper surface of the second plate in the cross sectional view of the first plate and the second plate, the second recess being aligned with the first recess in vertical direction, to fasten the first plate and the second plate together.

And in another aspect an interconnection arrangement for a work machine is disclosed or implemented. The interconnection arrangement for the work machine can comprise a first plate which is a part of the work machine and a key plate, the first plate being rotatable about a shaft of the work machine in a vertical direction and, the key plate having at least one top surface and at least one first contact surface as a slope surface in a cross sectional view of the key plate. The first plate and the key plate can be adapted to interface with another plate.

Other features and aspects of this disclosure will be apparent from the following description and the accompanying drawings.

DETAILED DESCRIPTION

The present disclosure relates to work machines, and more particularly to work machines, such as forestry work machines, having a cab and a cab riser which is tiltably coupled to a body, and systems, assemblies, and methods thereof. Generally, embodiments of the disclosed subject matter can implement a key plate to reliably couple the cab riser to a main body of the work machine, where the key plate can be mounted between a first plate, which can be a part of the cab riser, and a second plate which can be a part of the main body. Optionally, the key plate may be part of the first plate or part of the second plate (i.e., formed in one piece with the first plate or the second plate).

Figure 1:
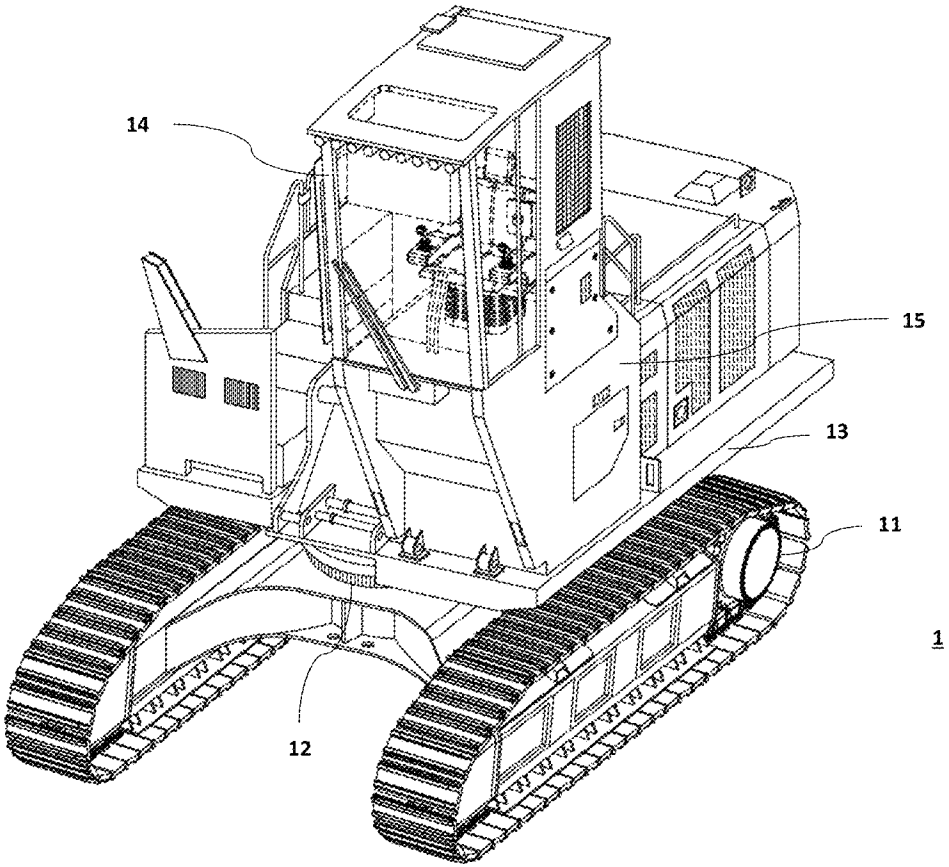
FIG. 1 is a perspective view of a forestry work machine as example of a work machine according to one or more embodiments of the disclosed subject matter.
Figure 2:
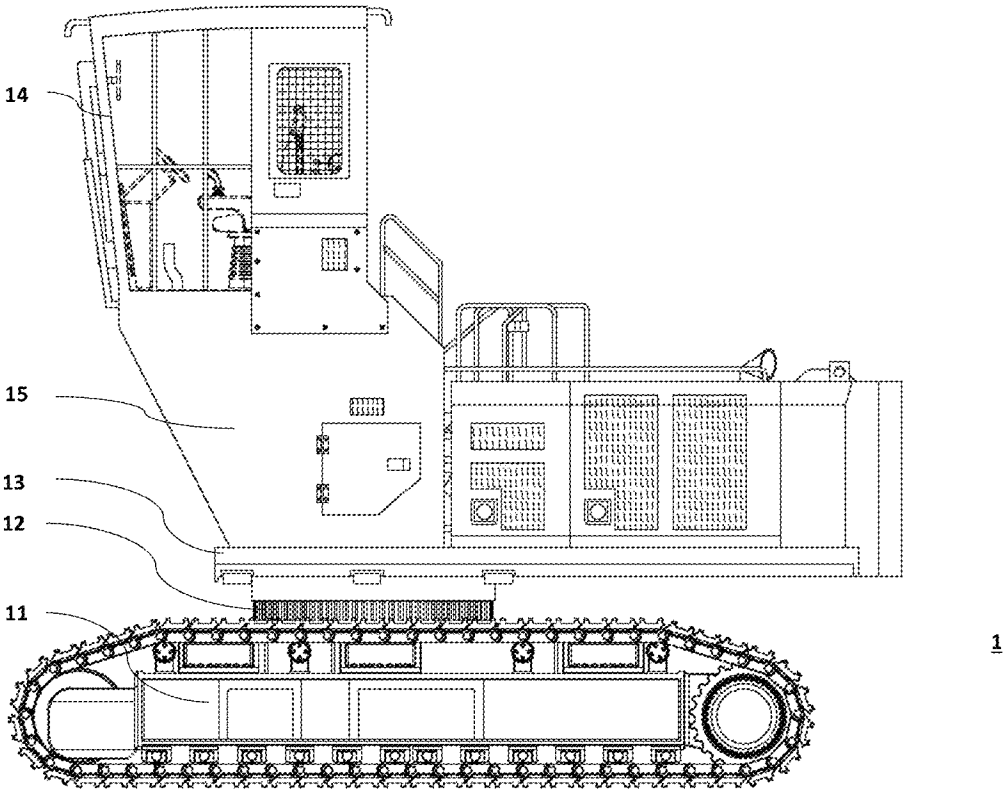
FIG. 2 is a side view of the work machine of FIG. 1.

Turning to the figures, FIG. 1 shows a perspective view of a forestry work machine as example of a work machine 1 according to one or more embodiments of the disclosed subject matter, though embodiments of the disclosed subject matter are not so limited. FIG. 2 shows a side view of the work machine 1 shown in FIG. 1.

Referring to FIG. 1 and FIG. 2, the work machine 1 can have a main body 13 and a lower traveling body 11. In the work machine 1, the main body 13 can be rotatably provided as a machine body on the lower traveling body 11 as an upper swing body, via a swing bearing portion 12. A cab 14 can be mounted on a cab riser 15 that serves as a base for mounting the cab 14 on one side of a front part of the main body 13. The cab 14 can be integrally formed on the cab riser 15, that is, the cab 14 can be a part of the cab riser 15. In the cab 14, an operator's seat, an operation lever, and the like can be installed. The cab 14 and the cab riser 15 can be formed integrally and tiltably coupled to the main body 13 (e.g., the machine body). In other instances, the cab 14 and the cab riser 15 may be separately fabricated and/or separably coupled. Alternatively, the cab 14 and the cab riser 15 may be regarded as two sections of one element, such as a prefabricated element and/or inseparable element.

In FIGS. 1-2, a door to the cab 14 can be provided in a rear side of the cab 14 so that the operator can ride access inside the cab 14. Also, the cab 14 may include one or more viewports 31 (e.g., a window, opening, etc.) that allow an operator positioned within the cab 14 to view outside.

Furthermore, a boom for work can be mounted on the other side of the front part of the main body 13. An engine and a power device such as a hydraulic pump which is driven by the engine can be mounted on the rear part of the main body 13.

Figure 3:
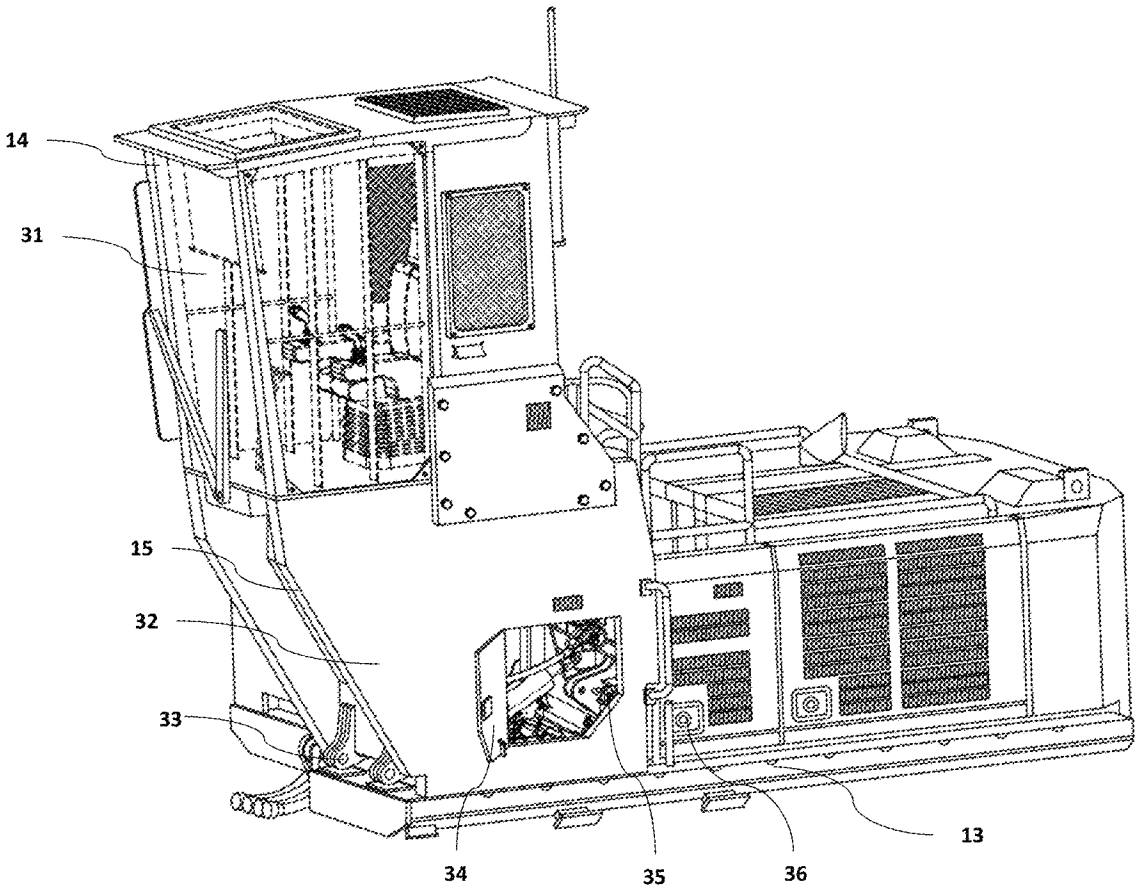
FIG. 3 is a perspective view a cab and a cab riser of the work machine of FIG. 1 in an operation position.
Figure 4:
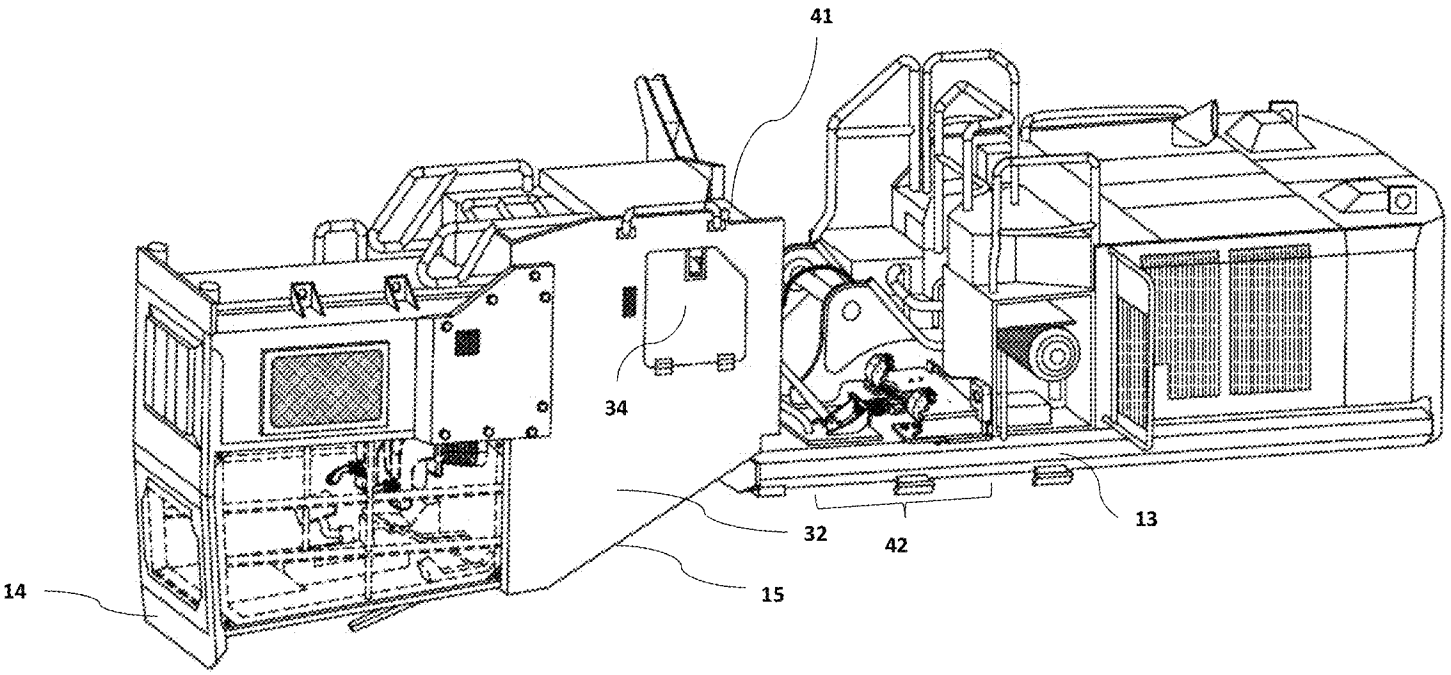
FIG. 4 is a perspective view a cab and a cab riser of the work machine of FIG. 1 in a transportation position.

Turning now to FIGS. 3-4, FIG. 3 is a perspective view of the cab 14 and the cab riser 15 of the work machine 1 of FIG. 1 and FIG. 2 in an operation position, and FIG. 4 is a perspective view the cab 14 and the cab riser 15 of the work machine 1 of FIG. 1 and FIG. 2 in a transportation position. The operation position and the transportation position may be referred to herein as a first position and a second position, respectively. The cab 14 and the cab riser 15 may be tiltably coupled with the work machine 1 such that the cab 14 and the cab riser 15 can tilt about a shaft 33 from the illustrated upright position (i.e., the operation position) as shown in FIG. 3 to the tilt position (i.e., the transportation position) as shown in FIG. 4. The shaft 33 can be provided on the front end of the main body 13, which rotatably connects the cab riser 15 to a main body 13. The cab riser 15 can rotate about the shaft 33 in a clockwise direction and a counterclockwise direction to and from the operation position and the transportation position. An actuator to tilt (e.g., a cylinder, a ball screw, any electric or hydraulic actuators, etc.) can be provided on the main body 13 where the bottom of the cab riser 15 contacts. The base of the actuator can be positioned on the main body 13 and the end of the actuator can be positioned toward a rear direction of the cab riser 15. When the actuator expands, the cab riser 15 can be tilted forward around the shaft 33, such as shown in FIG. 4, and when the actuator contracts, the cab riser 15 can be tilted to stand upright, such as shown in FIG. 3. A switch 36 to control the actuator to tilt the cab riser 15 can be provided at a side of a component which can be mounted on the main body 13 as a part of the main body 13, for instance.

Referring to FIG. 4, a cavity 41 may be located on a rear face of the cab riser 15. The cavity 41 may be adapted to be coupled with a clamping assembly 42 of the work machine 1. Further, the cavity 41 may be adapted to house a frame that is used to fasten the cab 14 and the cab riser 15 to the main body 13 of the work machine 1.

According to the one or more embodiments of the disclosed subject matter, the clamping assembly 42 can be provided on the main body 13 of the work machine 1. The clamping assembly 42 may include a base structure, a clamping structure, and an actuator to move the clamping structure linearly in a forward running direction of the work machine 1. Such movement may be according to a first linear direction (e.g., opposite the forward running direction) for clamping and in a second direction opposite the first direction (e.g., forward running direction) for unclamping.

As shown in FIGS. 3-4, the cab riser 15 may include an access door 34 located on a side face 32 of the cab riser 15. According to embodiments, an operator of the work machine 1, which may not necessarily be the same person who accesses the cab 14, can open the access door 34 to access switches inside of a housing of the cab riser 15 through the access door 34. A switch 35 to activate the clamping assembly 42 can be disposed adjacent to the clamping assembly 42 where the operator can operate through the access door 34. The detail mechanism of the clamping assembly 42 will be described below.

Figure 5:
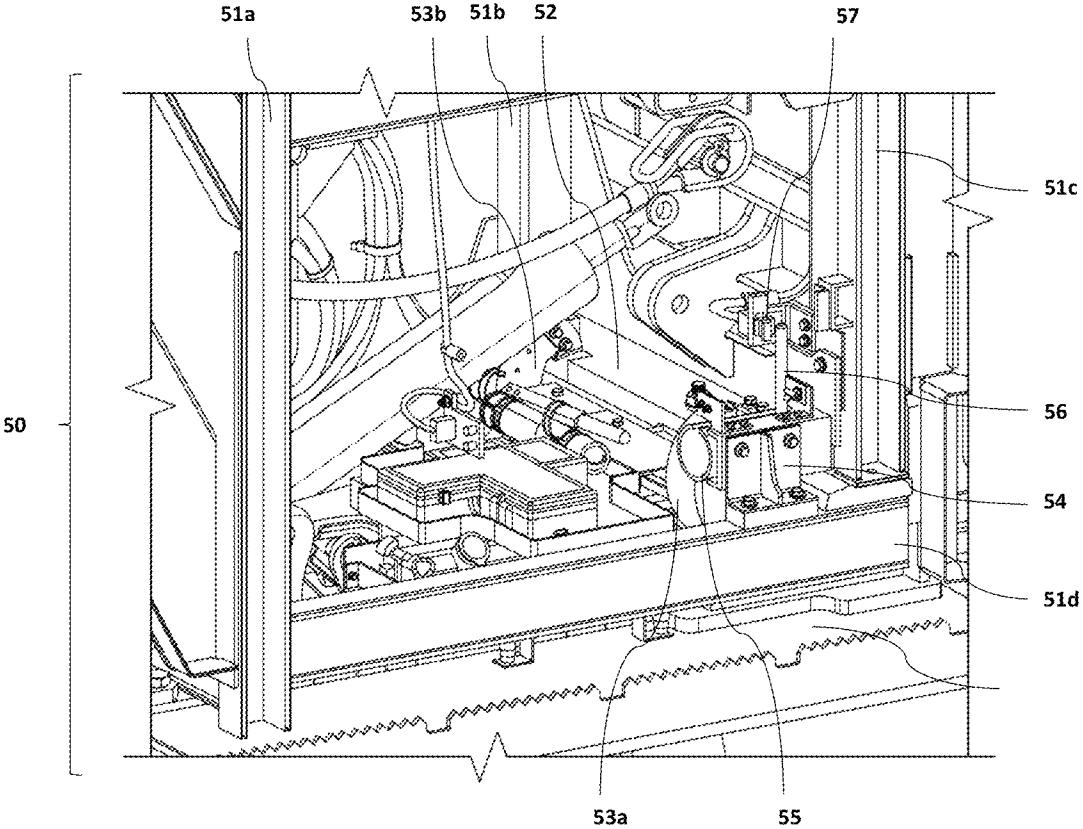
FIG. 5 is a perspective view of inside the cab riser in the operation position as shown in FIG. 3.

Turning now to FIG. 5, FIG. 5 shows a perspective view of inside the cab riser 15 in the operation position as shown in FIG. 3. In FIG. 5, one side portion of the housing of the cab riser 15 is removed for explanation of the inside.

According to one or more embodiments, the cab riser 15 may comprise supporting members 51*a* to 51*c*, each of which may be a columnar member extending vertically in the operation position, as a frame 50 to support the cab 14. A supporting member 51*d* may be connected to the supporting member 51*a* at one end as part of the frame and extend horizontally along the forward running direction, in the operation position. Similarly, another lateral supporting member may be connected to another columnar supporting member at one end as part of the frame and extend horizontally along the forward running direction in parallel to the supporting member 51*d*, in the operation position.

A plate 52, which may be flat, may be arranged to bridge a gap between the supporting member 51*d* and the other lateral supporting member which is mounted in parallel to the supporting member 51*d*, along an orthogonal direction to the running direction. At one edge of the plate 52, a lower surface of the plate 52 may contact a top surface of the supporting member 51*d*, and the lower surface of the plate 52 may be fastened to the supporting member 51*d*. The other edge of the plate 52 may contact a top surface of the other lateral supporting member, and the other edge of the plate 52 may be fastened to the other lateral supporting member. The plate 52 may be referred to herein as a first plate.

In one embodiment, the supporting member 51*c* may be mounted on an upper surface of the plate 52 and a bottom surface of the supporting member 51*c* may contact the upper surface of the plate 52 at one end. Similarly, the other columnar supporting member may be mounted on an upper surface of the plate 52 and a bottom surface of the other columnar supporting member may contact the upper surface of the plate 52 at one end. The plate 52 and the supporting member 51*c* or the other columnar supporting member may be fastened by a fastening member (e.g., a bolt with a nut and a washer, a screw, etc.).

It is noted that embodiments of the disclosed subject matter are not limited to the specific arrangement of the plate 52 as shown in FIG. 5. For instance, embodiments of the disclosed subject matter can arrange the plate 52 in different positions as a part of the frame of the cab riser 15 of the work machine 1.

As shown in FIG. 5, clamps 53*a* and 53*b*, each of which may be C-shaped, may be arranged adjacent to the plate 52. The clamps 53*a* and 53*b* can be arranged at opposite edge portions of the plate 52 in a longitudinal direction of the plate 52. The detail of the clamps 53*a* and 53*b* will be described with reference to FIG. 6. Though FIG. 5 shows two clamps, embodiments of the disclosed subject matter are not so limited and may instead include only one clamp, for instance.

As shown in FIG. 5, a base member 54 may be mounted on the supporting member 51*d* adjacent to the plate 52 and fastened to the supporting member 51*d* by a fastening member (e.g., a bolt with a nut and a washer, a screw, etc.) at one end. At the other end of the base member 54, a cylindrical member 55 can be connected to the base member 54 so that the cylindrical member 55 can extend along the forward running direction of the work machine 1. The inside of the cylindrical member 55 can be hollow to receive a locking member, such as a slide bolt with a handle 56 extending, for instance, upward, from a body of the locking member. More specifically, the locking member can penetrate a through hole (e.g., a slot or a slit) which can be arranged on the clamping assembly 42, by sliding the handle 56 manually in a direction opposite the forward running direction of the work machine 1. In the embodiment, the cylindrical member 55 and the locking member can be used for locking or otherwise retaining the cab riser 15 to the main body 13 of the work machine 1, in addition to the clamping structure (e.g., clamps 53*a* and 53*b*), when the cab riser 15 is in the first position. Such additional locking or retention of the cab riser 15 relative to the main body 13 of the work machine 1 can be to make decoupling of the cab riser 15 even more unlikely, which can improve safety.

As shown in FIG. 5, a switch 57 to activate an electric actuator which can be connected to the clamps 53*a* and 53*b* can be arranged as a part of the frame of the cab riser 15, adjacent to the access door 34 as shown in FIG. 3, for instance, so that the operator can operate the switch 57 through the access door 34.

Figure 6:
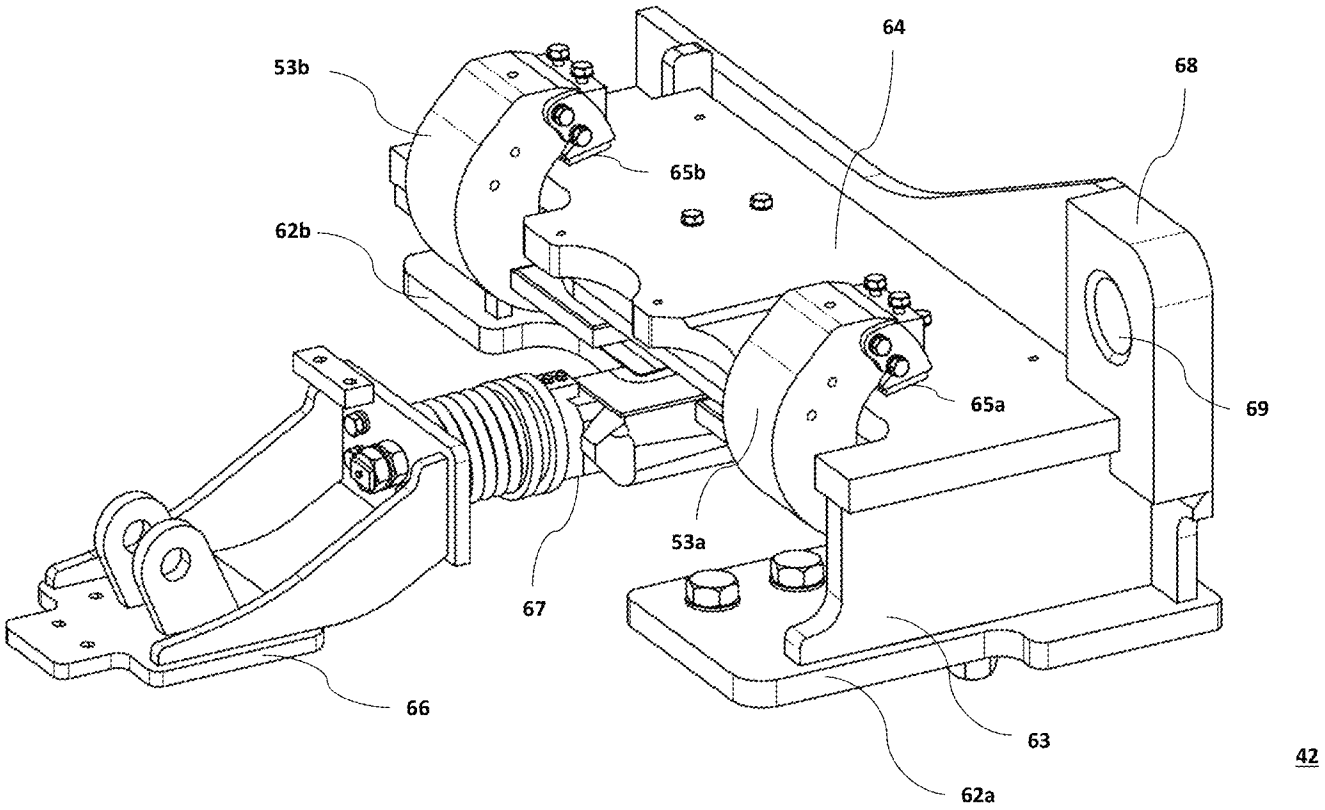
FIG. 6 is a perspective view of a clamping assembly of a work machine according to embodiments of the disclosed subject matter.

Turning now to FIG. 6, FIG. 6 shows a perspective view of a clamping assembly 42 of a work machine according to embodiments of the disclosed subject matter.

As shown in FIG. 6, the clamping assembly 42 can include base members 62*a* and 62*b*, a support member 63, a plate 64, which may be flat, the clamps 53*a* and 53*b*, a base member 66, an electrical actuator 67, and a connecting member 68. In the embodiment, the base member 62*a* and the base member 66 can be mounted on the main body 13 by a fastening member (e.g., a bolt with a nut and a washer, a screw, etc.).

According to one or more embodiments, the support member 63 can be mounted on the base member 62*a* vertically to support the plate 64 and the connecting member 68. The plate 64 can be connected to the support member 63 at one end and to other support member which is mounted on the base member 62*b* at the other end. As shown in FIG. 6, the plate 64 can be shaped to have recesses on one edge in the lateral direction, to receive the clamps 53*a* and 53*b*. The plate 64 may be referred to herein as a second plate.

Each of the clamps 53*a* and 53*b*, again, which can have a C-shape in a side elevational view, can have a bottom contact surface 65*a* and 65*b*, respectively. The bottom contact surface 65*a* can be angled to contact an upper surface of the plate 52 (i.e., first plate) of the cab riser 15. Similarly, the bottom contact surface 65*b* can be angled to contact the upper surface of the plate 52 (i.e., first plate) of the cab riser 15.

In the embodiment, the clamps 53*a* and 53*b* can be connected to the electric actuator 67, which can provide the clamps 53*a* and 53*b* with movement in the forward running direction of the work machine 1 and in an opposite direction. For example, the electric actuator 67 can move the clamps 53*a* and 53*b* opposite the forward running direction to engage the upper surface of the plate 52 of the cab riser 15, when the cab riser 15 is in the first or operating position. On the other hand, the electric actuator 67 can move the clamps 53*a* and 53*b* in the opposite direction, i.e., in the forward running direction, to disengage the upper surface of the plate 52 of the cab riser 15, for instance, so the cab riser 15 can be operated to move to the second or transportation position.

As shown in FIG. 6, the electric actuator 67 can be connected to the base member 66 at the other end. Additionally, the electric actuator 67 can provide a predetermined force to push the clamps 53*a* and 53*b* in the opposite direction to the forward running direction during in an engaged state by the clamps 53*a* and 53*b*.

It is noted that embodiments of the disclosed subject matter are not limited to the electric actuator 67 as shown in FIG. 5 and FIG. 6. For instance, embodiments of the disclosed subject matter can adopt a hydraulic actuator instead of the electric actuator to move the clamps 53*a* and 53*b*.

Also, it is noted that embodiments of the disclosed subject matter are not limited to the number of the clamps 53*a* and 53*b* as two as shown in FIG. 6. For instance, embodiments of the disclosed subject matter can adopt one clamp or three or more clamps to clamp the plate 52 and the plate 64 together. Optionally or alternatively, the one or more clamps can be arranged at any points around the plate 52 and the plate 64 in a top plan view.

Here, in FIG. 6, the connecting member 68 can be mounted on the support member 63 and the plate 64. As noted above, the connecting member 68 can comprise a through hole 69, for instance, at a center thereof to receive the locking member from the cab riser 15. The diameter of the through hole 69 may match the diameter of the cylindrical member 55.

Figure 7:
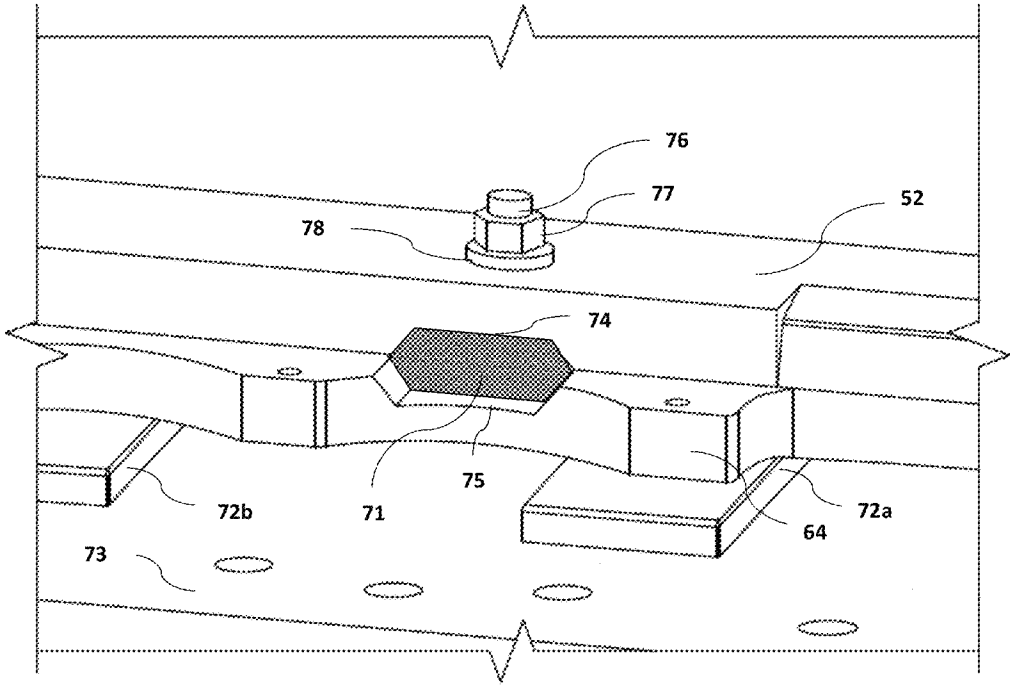
FIG. 7 is a schematic illustration of coupling a first plate and a second plate with a key plate between the first plate and the second plate according to embodiments of the disclosed subject matter.

Turning now to FIG. 7, FIG. 7 shows a schematic illustration of coupling a first plate (i.e., the plate 52) and a second plate (i.e., the plate 64) with a key plate 71 plate between the first plate and the second plate according to embodiments of the disclosed subject matter.

As shown in FIGS. 6-7, support members 72*a* and 72*b* and a plate 73, which may be arranged in parallel to the plate 64 vertically, may be a part of the clamping assembly 42. The plate 73 may be connected to the support member 63 at one end in the longitudinal direction and the support members 72*a* and 72*b* may be mounted on an upper surface of the plate 73.

According to one or more embodiments, the key plate 71 can be detachably or removably arranged between the plate 52 and the plate 64. More specifically, the lower surface of the plate 52 can be provided with a first recess 74 and the upper surface of the plate 64 can be provided with a second recess 75 to accommodate the key plate 71.

The key plate 71 can be formed to approximately match a shape of a space created by the first recess 74 and the second recess 75 in the engaged state of the clamps 53*a* and 53*b*. Optionally, the key plate 71 may have a width (i.e., into the page of FIG. 7) that is different (e.g., less than) the width of the first recess 74 and/or the second recess 75. In one or more embodiments, a material of the key plate 71 can be a metal and can be shaped by shaving the material, for instance, rather than casting, which can improve the material yield.

Optionally, as shown in FIG. 7, the key plate 71 can be attached to the plate 52 with a fastening member, such as a bolt 76, a nut 77, and a washer 78. The fastening member can be provided by any fastening means (e.g., bolts, nuts, washers, screws, clamps, etc.) and is not limited to the disclosed example. Variations of arrangement of the key plate 71 and the fastening member will be described in FIGS. 10A-10E.

As a result, by positioning the key plate 71 between the plate 52 and the plate 64, the two plates can contact firmly without undesirable movement (e.g., rattling) in right and left directions of the work machine 1. The variation of arrangement of the key plate 71 and the shape of the key plate 71 will be described in FIGS. 10A to 10E and 11A to 11C.

Figure 8:
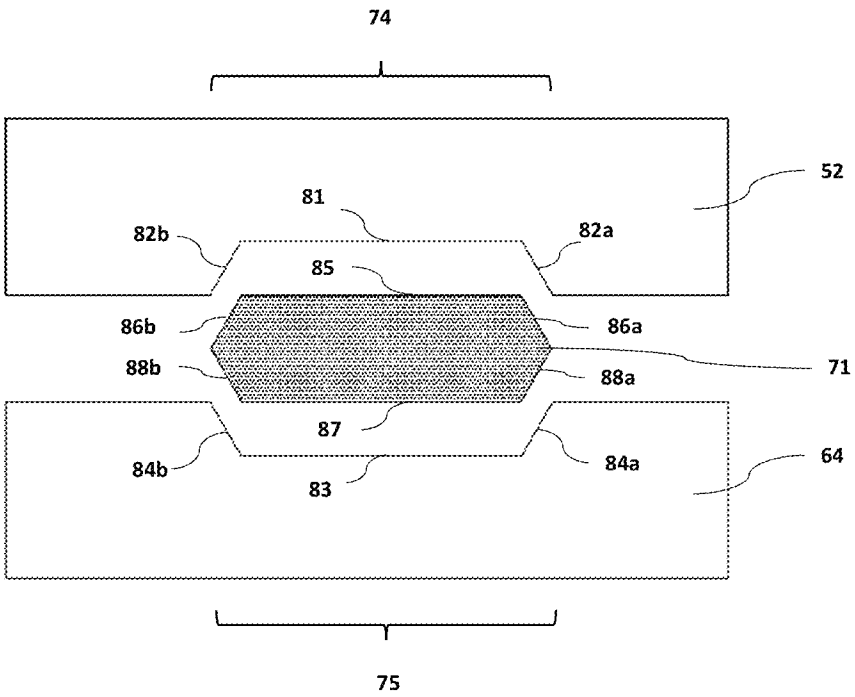
FIG. 8 shows a cross sectional view of the schematic illustration of positioning the first plate relative to the second plate with the key plate therebetween according to embodiments of the disclosed subject matter.

Turning now to FIG. 8, FIG. 8 shows a cross sectional view of a schematic illustration of positioning the first plate 52 relative to the second plate 64 with the key plate 71 therebetween according to embodiments of the disclosed subject matter.

As shown in FIG. 8, the first recess 74 can be formed by three surfaces (at least in the cross sectional view), a bottom surface 81, a first slope surface 82*a*, and a second slope surface 82*b*, so that the first recess 74 may be a trapezoidal shape, for instance, in the cross sectional view. Similarly, the second recess 75 can be formed by three surfaces (at least in the cross sectional view), a bottom surface 83, a first slope surface 84*a*, and a second slope surface 84*b*, so that the second recess 75 may be a trapezoidal shape, for instance, in the cross sectional view.

The key plate 71 can be inserted into a space created by the first recess 74 and the second recess 75 when the plate 52 and the plate 64 are positioned adjacent to each other (e.g., for clamping by the clamping structure such as the clamps 53*a* and 53*b* in the engaged state). Thus, the key plate 71 can be formed to approximately match the shape of the space created by the first recess 74 and the second recess 75 in the engaged state of the clamps 53*a* and 53*b*, that is, when the cab 14 is positioned in the operation position.

An upper half of the key plate 71 can be composed of three surfaces, a top surface 85, a slope surface 86*a*, and a slope surface 86*b* in the cross sectional view, for instance, of FIG. 8. The top surface 85 of the key plate 71 may be flat to be substantially in parallel with the bottom surface 81 of the first recess 74 arranged on the plate 52. The slope surface 86*a* and the slope surface 86*b* may be inclined with respect to the horizontal direction in different directions, so that the slope surface 86*a* and the slope surface 86*b* may fit to the slope surface 82*a* and the slope surface 82*b*, respectively. When the cab 14 is positioned in the operating position, and in a state that the plate 52 is placed on the plate 64 by gravity, there can be a slight gap (e.g., 0.5 mm-1.0 mm) between the top surface 85 of the key plate 71 and the bottom surface 81 of the first recess 74 arranged on the plate 52. In other words, when the plate 52 approaches the plate 64 by its own weight upon placing the cab 14 in the operating position, the slope surfaces 82*a* and 82*b* of the first recess can contact the slope surfaces 86*a* and 86*b* of the key plate 71, respectively, and the key plate 71 can be positioned along the slope surfaces. At that time, the bottom surface 81 of the first recess 74 can approach the top surface 85 of the key plate 71 substantially in parallel, but may not be completely in contact with each other. Instead, there can be a thin gap between the top surface 85 of the key plate 71 and the bottom surface 81 of the first recess 74 so that the slope surfaces can contact first.

A lower half of the key plate 71 can be composed of three surfaces, a top surface 87, a slope surface 88*a*, and a slope surface 88*b* in the cross sectional view, for instance, of FIG. 8. The top surface 87 of the key plate 71 may be flat to be substantially in parallel with the bottom surface 83 of the second recess 75 arranged on the plate 64. The slope surface 88*a* and the slope surface 88*b* may be inclined with respect to the horizontal direction in different directions, so that the slope surface 88*a* and the slope surface 88*b* may fit to the slope surface 84*a* and the slope surface 84*b*, respectively. When the cab 14 is positioned in the operating position, and in a state that the plate 52 is placed on the plate 64 by gravity, there can be a slight gap (e.g., 0.5 mm-1.0 mm) between the top surface 87 of the key plate 71 and the bottom surface 83 of the second recess 75 arranged on the plate 64. In other words, when the plate 52 approaches the plate 64 by its own weight upon placing the cab 14 in the operating position, the slope surfaces 84*a* and 84*b* of the second recess can contact the slope surfaces 88*a* and 88*b* of the key plate 71, respectively, and the key plate 71 can be positioned along the slope surfaces. At that time, the top surface 87 of the key plate 71 can approach the bottom surface 83 of the second recess 75 substantially in parallel, but may not be completely in contact with each other. Instead, there can be a thin gap between the top surface 87 of the key plate 71 and the bottom surface 83 of the second recess 74 so that the slope surfaces can contact first.

Upon starting the transition from the transportation position to the operation position of the work machine 1, the key plate 71 may be mounted on the bottom surface 83 of the second recess 75 of the plate 64 so that the center position of the key plate 71 can be aligned to the center position of the second recess 75 in a top view. The operation of mounting the key plate 71 can be guided smoothly by the slope surfaces 84*a* and 84*b* of the second recess 75 and the slope surfaces 88*a* and 88*b* of the key plate 71. Next, the plate 52 may approach to the top surface 85 of the key plate 71 in an arc about the shaft 33 in conjunction with the tilting movement of the cab riser 15 to the main body of the work machine 1 in a cross sectional view. After the plate 52 gets close enough to the plate 64, the first recess 74 of the plate 52 may be smoothly guided to the top surface 85 of the key plate 71 in the correct position, along the slope surfaces 82*a* and 82*b* of the first recess 74 and the slope surfaces 86*a* and 86*b* of the key plate 71.

Optionally, the thickness of the key plate 71 may be adjusted to be slightly thinner than the height of the space created by the first recess 74 and the second recess 75. As described above, by contacting the slope surfaces of the key plate 71 and the slope surfaces of the plate 52 and the plate 64, there may be a thin gap (e.g., 0.5 mm to 1.0 mm) between the lower surface of the plate 52 and the upper surface of the plate 64 in a fitting state that the plate 52 is placed on the plate 64 by gravity, before clamping the two plates by the clamps 53*a* and 53*b*, in the cross sectional view. Subsequently, by clamping the plate 52 and the plate 64 with the clamping structure such as the clamps 53*a* and 53*b*, the key plate 71 can be firmly engaged in the space formed by the first recess 74 and the second recess 75 and the two plates can be fastened more firmly. Optionally or alternatively, by clamping the plate 52 and the plate 64 with the clamping structure, at least one of the plate 52 and the plate 64 can be slightly deformed by elastic deformation, and the top surface 85 and the top surface 87 can be directly in contact with the bottom surface 81 of the first recess 74 and the bottom surface 83 of the second recess 75. Such clamping may remove some or all of the thin gap.

As shown in FIG. 8, by providing the first and second recesses 74, 75 on the contact surfaces of the plate 52 and the plate 64 and inserting the key plate with the fittable shape into the space created by the first and second recesses 74, 75, for instance, as shown in the cross sectional view of FIG. 8, the slope surfaces of the first and second recesses 74, 75 and the slope surfaces of the key plate 71 can become a guide to position the two plates 52, 64 in a proper position in the top view. Furthermore, the key plate 71 can regulate the displacement of the plate 52 and the plate 64 in at least the lateral direction (e.g., including left and right directions in FIG. 8), prior to and in the engaged state using the clamps 53*a* and 53*b*. Specifically, when the first plate 52 and the second plate 64 are clamped by using the clamps 53*a* and 53*b*, the first plate 52 may need to ride on the key plate 71 in a case if the first plate 52 and the second plate 64 are laterally displaced. In that case, the gap between the first plate 52 and the second plate 64 may need to be widened. However, in that case, the clamping force with the clamps 53*a* and 53*b* in a vertical direction will be acted, and the structure may be more difficult to slip in the lateral direction.

Figure 9:
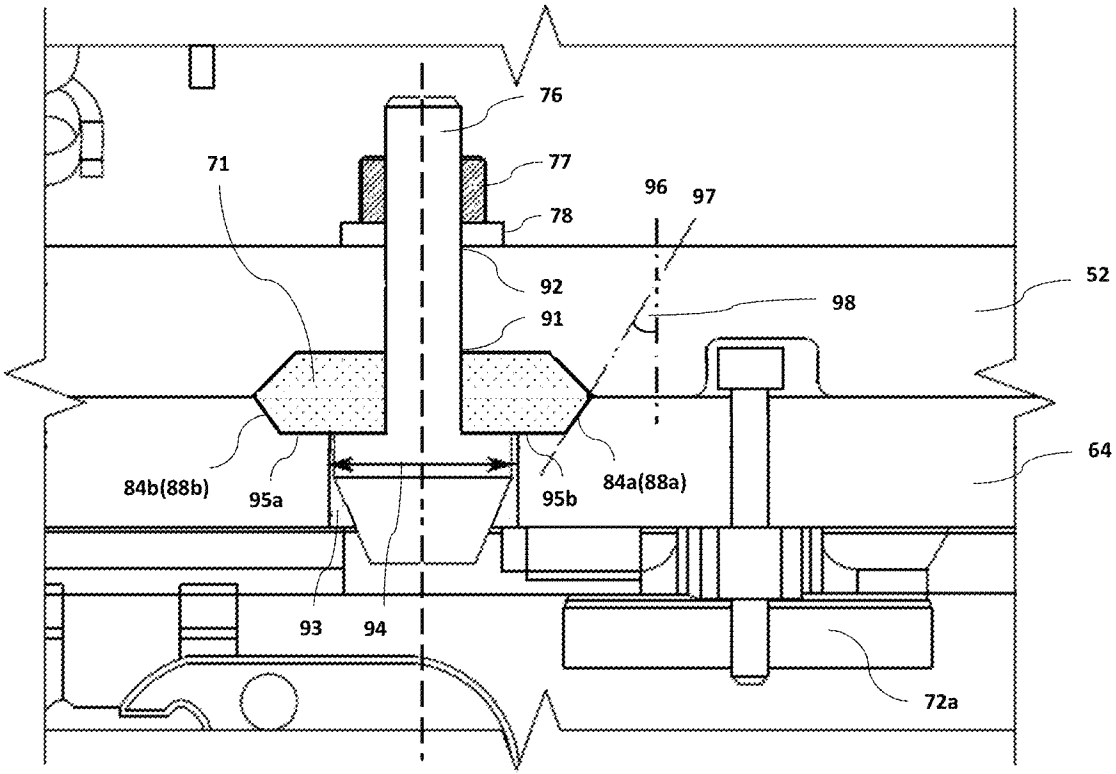
FIG. 9 shows a cross sectional view of a schematic illustration of a first plate provided adjacent to a second plate with a key plate of FIG. 7 between the first plate and the second plate.

Turning now to FIG. 9, FIG. 9 shows a cross sectional view of a schematic illustration of a first plate 52 provided adjacent to a second plate 64 with a key plate 71 of FIG. 7 between the first plate and the second plate. The plate 52 may be clamped to the second plate 64 in the position shown in FIG. 9, for instance, using the clamps 53*a* and 53*b*. Optionally or alternatively, according to embodiments of the disclosed subject matter, the key plate 71 can be attached in the first recess 74 of the plate 52 with the fastening member (e.g., the bolt 76, the nut 77, and the washer 78).

Here, as the example shown in FIG. 9, the key plate 71 can be formed with a through hole 91 at or approximately at the center in a top view of the key plate 71. Similarly, the plate 52 can be formed with a through hole 92 which can be aligned with the through hole 91 in a top view of the plate 52. The through hole 91 and the through hole 92 may have the same or approximately the same diameter.

Likewise, the plate 64 can be formed with a through hole 93 which can be aligned with the through hole 91 in a top plan view. According to one or more embodiments, a diameter 94 of the through hole 93 can be greater than the diameter of the though hole 91 and the through hole 92, for instance, to accommodate a fastening member in the form of the bolt 76, such as shown in FIG. 9. Here, in FIG. 9, the key plate 71 can approach a bottom surface 95*a* and a bottom surface of 95*b* of the plate 64 with a thin gap in the cross sectional view, which may surround the through hole 93 in the top plan view. As an example, a head of the fastening member in the form of the bolt 76 can be formed in a shape of a truncated cone whose outer diameter gradually decreases downward in the cross sectional view, such as shown in FIG. 9.

According to one or more embodiments, an angle 98 is an angle of a vertical line 96 and a diagonal line 97, which may correspond to at least one of an angle of the slope surface 84*a* relative to the vertical line 96 or an angle of the slope 88*a* relative to the vertical line 96 in the cross sectional view. Similarly, the slope surface 84*a* or the slope 88*a* relative to the vertical line 96 can be formed by approximately the same angle with the angle 98. In one embodiment, for example, the angle 98 can be 30 degrees but is not limited thereto.

Accordingly, the slope surfaces 84*a* and 84*b* of the second recess 75 of the plate 64 and the slope surfaces 88*a* and 88*b* of the lower half of the key plate 71 can become a guide to align the two plates 52, 64 in a proper position in the top plan view, when the cab riser 15 is tilted uprightly on the main body 13.

Furthermore, in the example as shown in FIGS. 7 and 9, the key plate 71 can be fastened to the plate 52 (i.e., first plate) by the fastening member, such as the bolt 76, the nut 77, and the washer 78, to enhance or improve retention. The key plate 71 can be mounted as a part of the cab riser 15 in both of the transportation position and the operation position in a case where the key plate 71 is fastened to the plate 52 by the fastening member. Further, the key plate 71 can be fixed to the plate 64 (that is, the second plate) by a fixing member and attached as a part of the main body 13 at both the transport position and the operation position. Further, the key plate 71 can be formed in one piece with either the plate 52 or the plate 64. As a result, it may be not necessary to attach and detach the key plate 71 manually at each time of the transition to/from the transportation position of the cab riser from/to the operation position of the cab riser 15, and improves the usability of the work machine 1.

Turning now to FIGS. 10A, 10B, 10C, 10D, and 10E, these figures show a cross sectional view of schematic illustrations of the first plate and the second plate with the key plate provided relative to each other in variation according to embodiments of the disclosed subject matter.

Figure 10A:
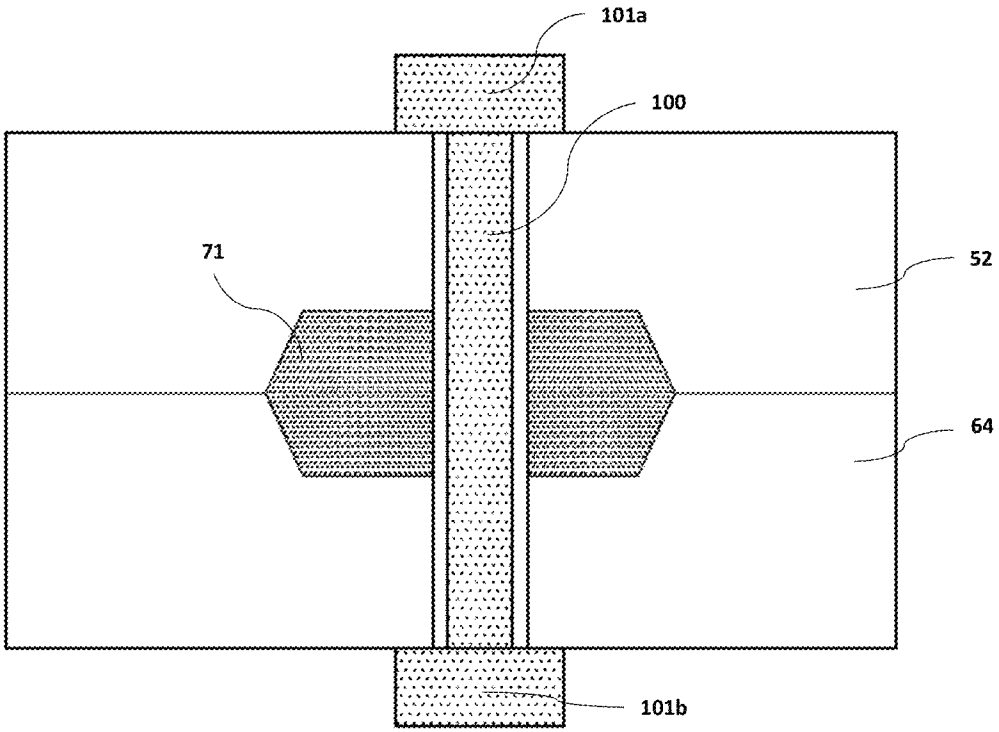
FIGS. 10A, 10B, 10C, 10D, and 10E show cross sectional views of schematic illustrations of fastening the first plate and the second plate with the key plate in variation according to embodiments of the disclosed subject matter.

As shown in FIG. 10A, the plate 52 and the plate 64 may be coupled by the key plate 71 and fastened by a fastening member including a fastener body 100 (e.g., a bolt, a screw, etc.) and fastening heads 101*a* and 101*b* which can be arranged approximately at the center of the key plate 71 in a top plan view. The fastener body 100 can be fixed to the plate 52 and the plate 64 at both ends by the fastener head 101*a* and the fastener head 101*b*, respectively. Here, the diameter of the fastener body 100 may be less than the diameters of thickness-wise openings through each of the plate 52, the plate 64, and the key plate 71. Here, the fastener head 101*a* and/or 101*b* can comprise a bolt, a nut, and a washer.

Figure 10B:
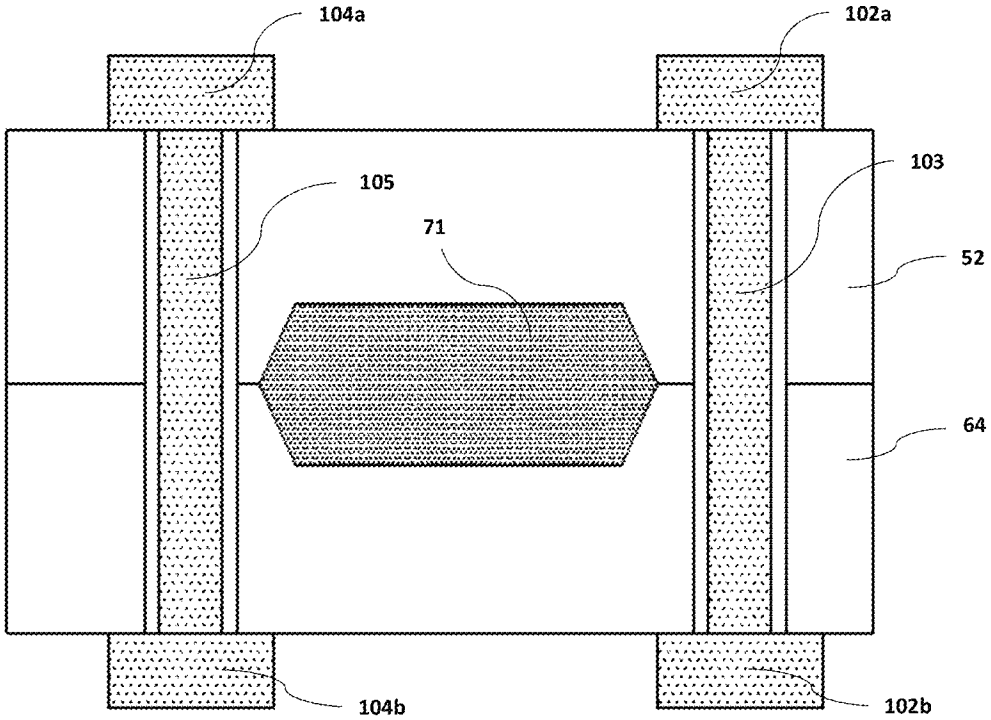

As shown in FIG. 10B, the plate 52 and the plate 64 may be coupled by the key plate 71 and a fastening member including a fastener body 103, a fastener body 105, and fastener heads 102*a*-102*b* and 104*a*-104*b*. The fastener body 103 and the fastener body 105 can be arranged symmetrically at both sides of the key plate 71 in a cross sectional view. The fastener body 103 can be fixed to the plate 52 and the plate 64 at both ends by the fastener head 102*a* and the fastener head 102*b*, respectively. Similarly, the fastener body 105 can be fixed to the plate 52 and the plate 64 at both ends by the fastener head 104*a* and the fastener head 104*b*, respectively. Here, the diameter of the fastener bodies 103 and 105 may be less than the diameters of thickness-wise openings through each of the plate 52 and the plate 64. Thus, in embodiments of the disclosed subject matter, no thickness-wise openings may be provided in the key plate 71.

Figure 10C:
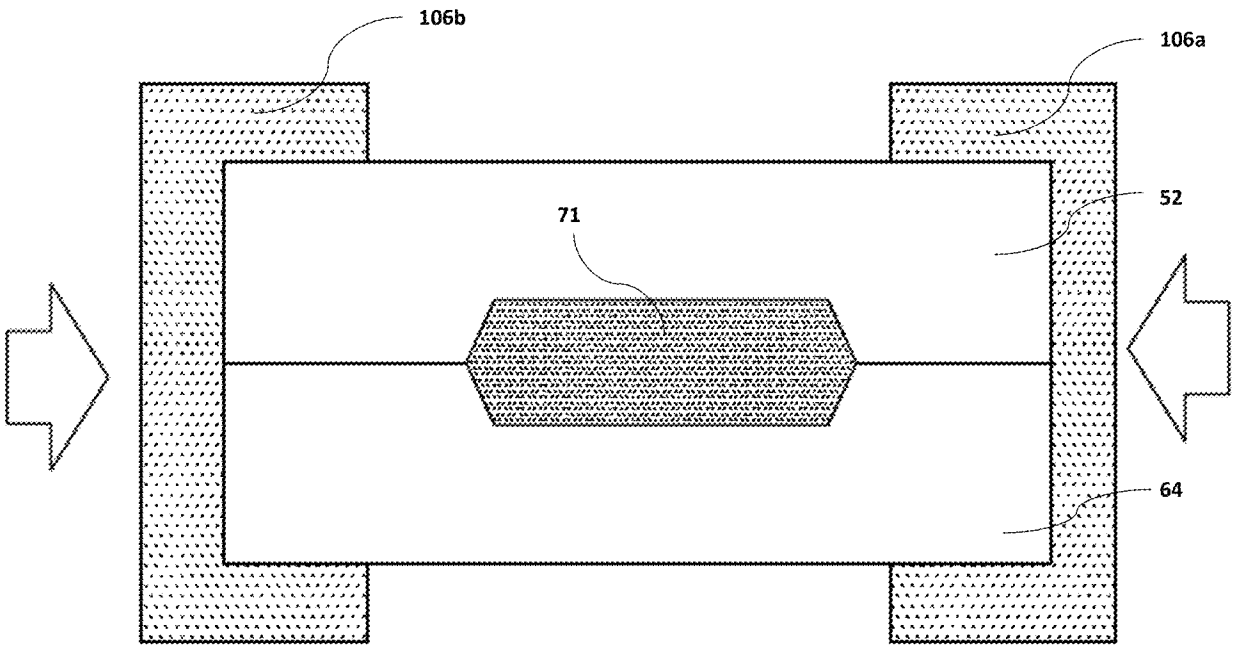

As shown in FIG. 10C, the plate 52 and the plate 64 may be coupled by the key plate 71 and clamped by a clamp 106*a* and a clamp 106*b*, which can be arranged symmetrically at both edges of the plate 52 and the plate 64 in a longitudinal direction in a cross sectional view. The clamps 106*a* and 106*b* can be provided in the same manner as the clamps 53*a* an 53*b* as shown in FIG. 6. Thus, in embodiments of the disclosed subject matter, no thickness-wise openings may be provided in any of the plate 52, the plate 64, or the key plate 71.

Figure 10D:
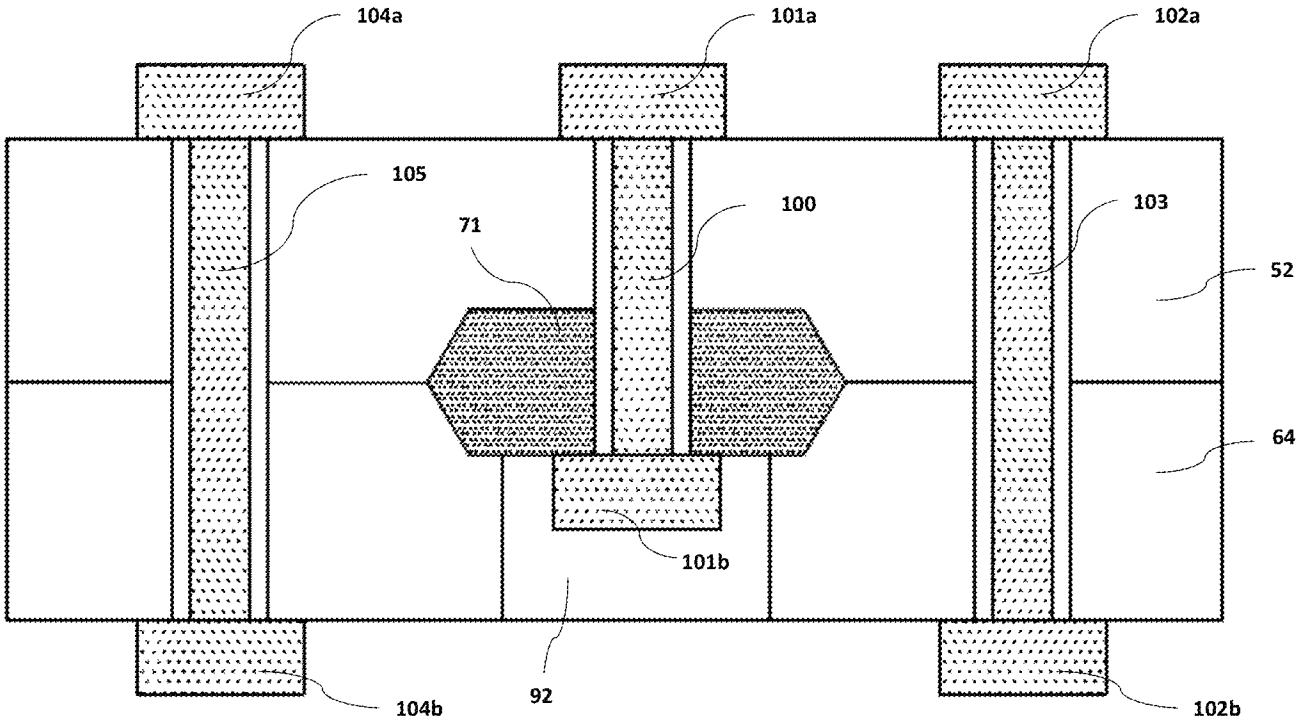

FIG. 10D shows another example of fastening the plate 52 and the plate 64 by the key plate 71, the fastener body 100, the fastener body 103, and the fastener body 105. The fastener body 100 can be arranged approximately at the center of the key plate 71 in a top plan view, and the fastener body 103 and the fastener body 105 can be arranged symmetrically at both sides of the key plate 71 in a cross sectional view. In the embodiment, the key plate 71 can be fixed to the plate 52 by the fastener head 101*a* at the upper surface of the plate 52 and by the fastener head 101*b* at the lower surface of the key plate 71. Here, the diameter of the fastener bodies 100, 103 and 105 may be less than the diameters of thickness-wise openings through each of the plate 52, the plate 64, and the key plate 71. In this example, the diameter of the thickness-wise opening of the plate 64 can be greater than the diameter of the thickness-wise opening of the plate 52.

Figure 10E:
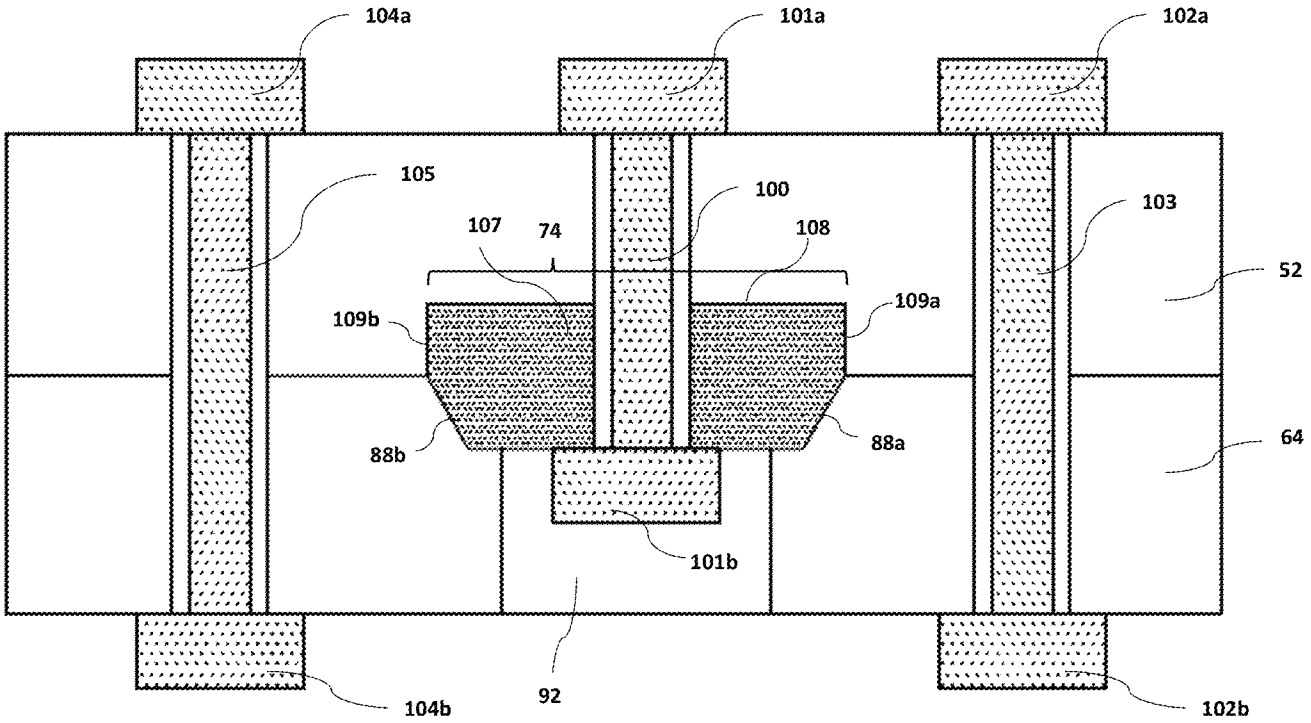

FIG. 10E shows another example of fastening the plate 52 and the plate 64 by the key plate 107 and the fastening member including the fastener body 100, the fastener body 103 and the fastener body 105. In the embodiment, the fastener body 100 can be arranged approximately at the center of the key plate 107 in a top plan view, and the fastener body 103 and the fastener body 105 can be arranged symmetrically at both sides of the key plate 107 in a cross sectional view. Additionally, in the embodiment, the key plate 107 can be fixed to the plate 52 by the fastener head 101*a* at the upper surface of the plate 52 and by the fastener head 101*b* at the lower surface of the key plate 107. Here, the diameter of the fastener bodies 100, 103 and 105 may be less than the diameters of thickness-wise openings through each of the plate 52, the plate 64, and the key plate 107. In this example, the diameter of the thickness-wise opening of the plate 64 can be greater than the diameter of the thickness-wise opening of the plate 52.

As shown in FIG. 10E, the first recess 74 can be approximately rectangular parallelepiped shape in the cross sectional view, since the positioning of the key plate 107 to the plate 52 may not be necessary. In the embodiment, the upper half of the key plate 107 may compose three surfaces, a top surface 108, a side surface 109*a*, and a side surface 109*b*, while the lower half of the key plate 107 may be formed by the same shape as the key plate shown in FIG. 8 in the cross sectional view. The top surface 108 may be flat in the horizontal direction, and the side surface 109*a* and the side surface 109*b* may be flat in the vertical direction, that is, the upper half of the key plate 107 can fit to the rectangular parallelepiped shape of the first recess 74. In this embodiment, the manufacturing process of the key plate 107 may be relatively simpler than the manufacturing process of the key plate 71, so the process time and the process cost can be reduced.

Accordingly, due to the key plate 71 or the key plate 107 which can regulate lateral displacement, for example, even when bolts are used as the fastening member to fix the two plates in the vertical direction, the shearing force applied to the bolts in lateral direction can be reduced and damage of the bolts by the shearing force can be avoided.

It is noted that any of the examples of the fastening member (e.g., fastener body 100, 103, and 105) and the clamping structure (e.g., the clamps 106*a* and 106*b*) shown in FIGS. 10A to 10E can be combined to clamp the plate 52 and the plate 64.

Figure 11A:
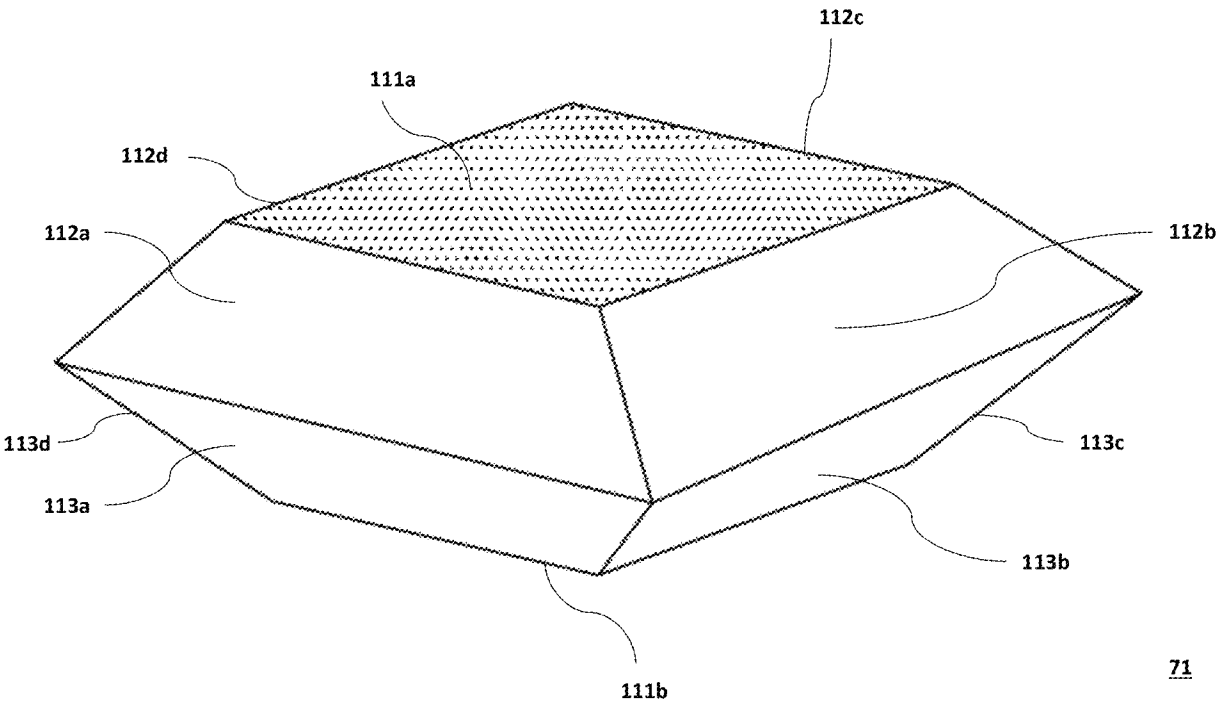
FIGS. 11A, 11B, and 11C show perspective views of the key plate in variation according to embodiments of the disclosed subject matter.
Figure 11B:
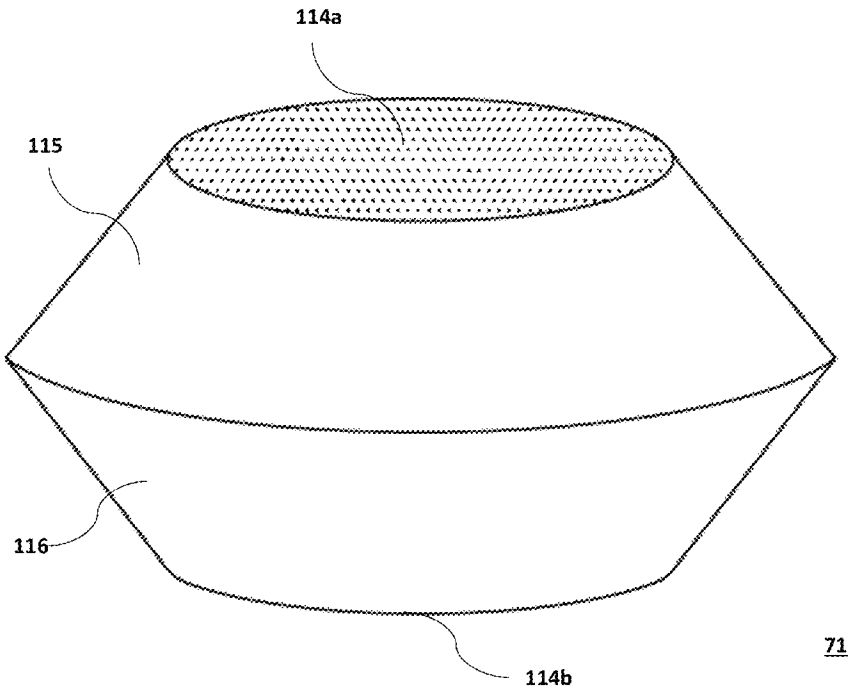
Figure 11C:
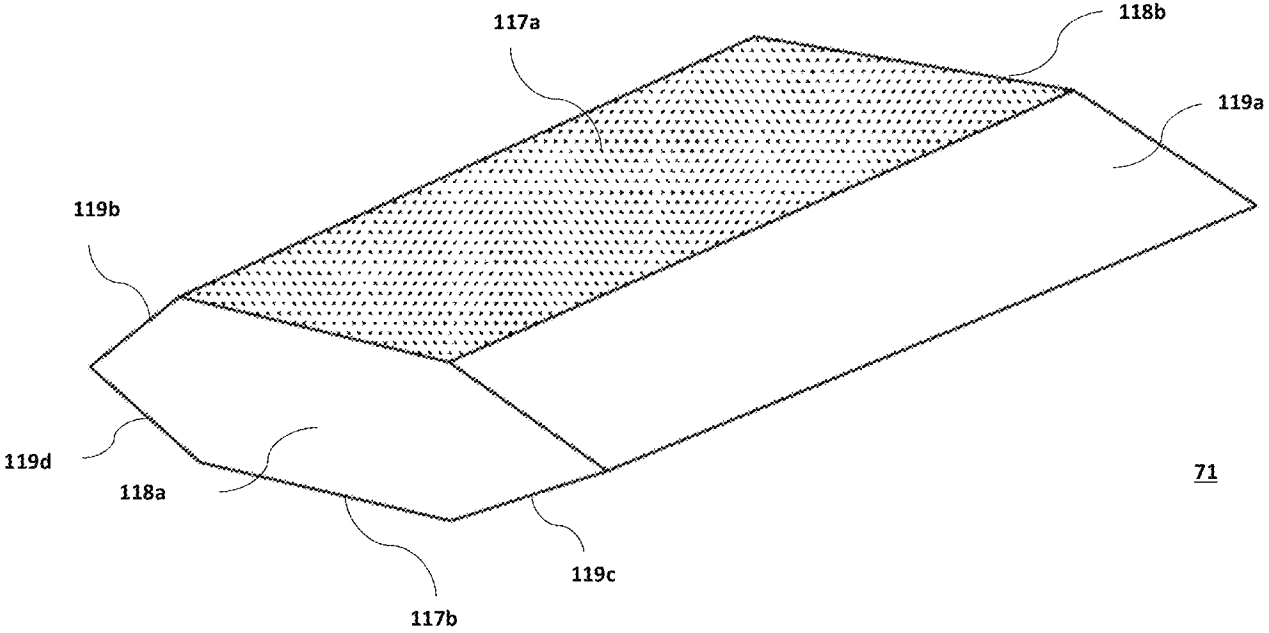

Turning now to FIGS. 11A to 11C, FIGS. 11A, 11B, and 11C show a perspective view of the key plate in variation according to embodiments of the disclosed subject matter.

As shown in FIG. 11A, the key plate 71 can be formed by top surfaces 111*a* to 111*b*, slope surfaces 112*a* to 112*d*, and slope surfaces 113*a* to 113*d*. The upper half of the key plate 71 may be composed of the top surface 111*a* and four slope surfaces 112*a* to 112*d* that can be inclined in different directions and can be formed by approximately quadrangular pyramid shape with the top surface 111*a*, which may be flat. Similarly, the lower half of the key plate 71 may be composed of the top surface 111*b* and four slope surfaces 113*a* to 113*d* that can be inclined in different directions and can be formed by approximately quadrangular pyramid shape with the top surface 111*b*, which may be flat. The lower half of the key plate 71 may be an inverted shape of the upper half of the key plate 71. According to one or more embodiments, each of the slope surface 112*a* to 112*d* and 113*a* to 113*d* can be a trapezoidal shape in a cross sectional view, and each of the top surface 111*a* and 111*b* can be a square shape in a top plan view.

As shown in FIG. 11B, the key plate 71 can be formed by top surfaces 114*a* to 114*b*, slope surfaces 115 and 116. The upper half of the key plate 71 may be composed of the top surface 114*a* and the slope surface 115 that can be inclined to be formed by approximately conical shape with the top surface 114*a*, which may be flat. Similarly, the lower half of the key plate 71 may be composed of the top surface 114*b* and the slope surface 116 that can be inclined to be formed by approximately conical shape with the top surface 114*b*, which may be flat. The lower half of the key plate 71 may be an inverted shape of the upper half of the key plate 71. According to one or more embodiments, each of the slope surface 115 and the slope surface 116 can be a trapezoidal shape in a cross sectional view, and each of the top surface 114*a* and 114*b* can be a circle shape in a top plan view.

As shown in FIG. 11C, a key plate 71 can be formed by top surfaces 117*a* to 117*b*, side surfaces 118*a* to 118*b*, slope surfaces 119*a* to 119*d*. According to one or more embodiments, each of the side surface 118*a* and 118*b* can be shown as a combined trapezoidal shape which two trapezoidal shapes disposed back-to-back in a cross sectional view, while each of the slope surface 119*a* to 119*d* can be a rectangular shape in a cross sectional view. Each of the top surface 117*a* and 117*b* can be a rectangular shape in a top plan view. The opposing side surfaces 118 and 118*b* each can be vertically oriented.

Accordingly, the slope surfaces of the key plate 71 as shown in FIGS. 11A to 11C can become a guide to align the two plates 52, 64 in a proper position in a top plan view, when the cab riser 15 is tilted uprightly on the main body 13. Furthermore, the key plate 71 can reduce the lateral displacement of the two plates 52, 64.

As noted above, the key plate 71 can be formed in various shapes. It is noted that embodiments of the disclosed subject matter are not limited to the specific shape of the key plate shown in FIGS. 11A to 11C (or elsewhere herein).

Figure 12:
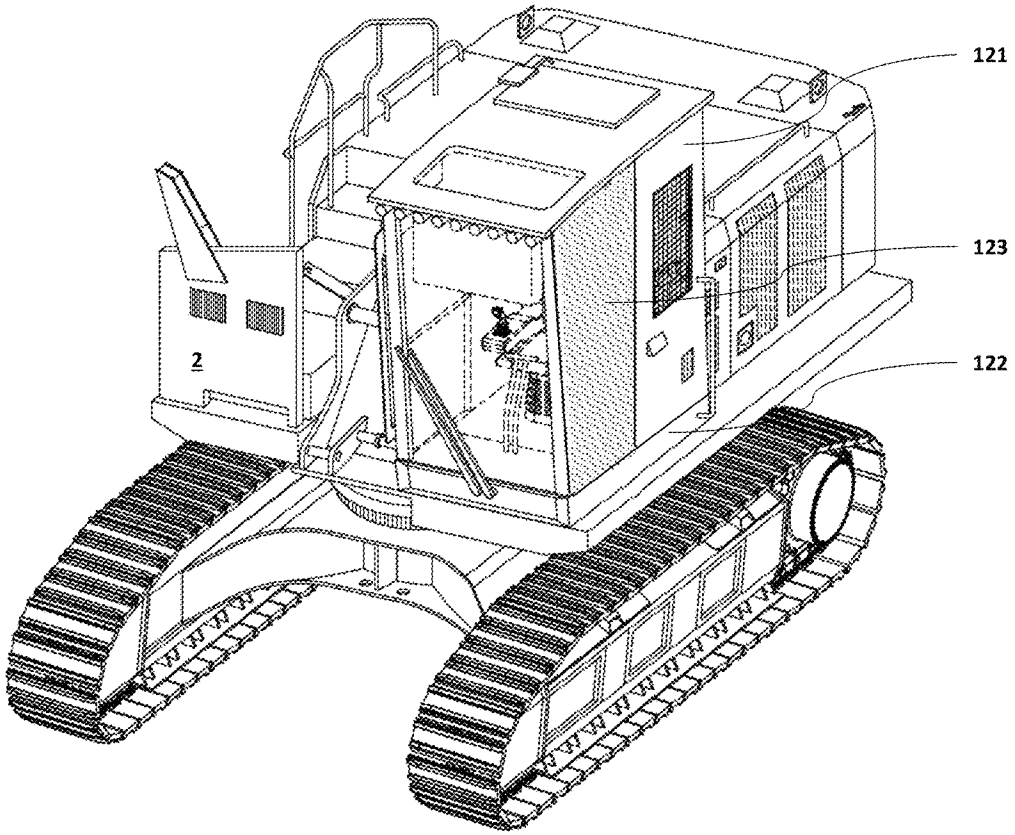
FIG. 12 is a perspective view of another forestry work machine as example of a work machine according to one or more embodiments of the disclosed subject matter.

Turning now to FIG. 12, FIG. 12 is a perspective view of another forestry work machine as example of a work machine 2 according to one or more embodiments of the disclosed subject matter. In FIG. 12, a height of a cab riser 122 and a position of a door 123 are different from those shown in FIG. 1. The operator of the work machine 2 may ride on to a cab 121 from the door 123 provided in a side direction of the cab 121. The positioning of the cab riser 122 relative to the main body, the clamping, and/or locking assemblies discussed herein can be equally applicable to the work machine 2.

It is noted that embodiments of the disclosed subject matter are not limited to the specific arrangement of the cab riser and position of a door as shown in FIG. 12. For instance, embodiments of the disclosed subject matter can arrange the cab riser and its parts in different positions of the work machine 2.

INDUSTRIAL APPLICABILITY

As noted above, the present disclosure relates to work machines, and more particularly to forestry work machines having a cab and a cab riser which is tiltably coupled to a body, and systems, assemblies, and methods thereof.

Embodiments of the disclosed subject matter can involve a work machine that can comprise a main body and a cab riser. The cab riser can include a cab and a frame, the cab being uprightly positioned on the work machine in a first position, and being tilted forward in a second position, and the frame comprising a first plate to contact a second plate provided on the main body in the first position. The first plate and the second plate can be coupled together to sandwich a key plate when the cab is in the first position, the key plate being disposed in a space created by a first recess on a lower surface of the first plate and a second recess on an upper surface of the second plate in a cross sectional view of the first plate and the second plate, the second recess being aligned with the first recess vertically when the cab is in the first position, and the key plate can include at least one first contact surface as a slope surface and at least one top surface, the top surface being adjacent to the slope surface and substantially in parallel with the first plate or the second plate in a vertical direction, in the cross sectional view of the key plate.

Alternatively, embodiments of the disclosed subject matter can involve a method. The method can comprise providing a key plate for a work machine, the key plate having at least one top surface and at least one first contact surface as a slope surface in a cross sectional view of the key plate; and providing the key plate between a first plate and a second plate of the work machine, the first plate being a part of a cab riser of the work machine, the second plate being a part of a main body of the work machine, and the first plate being mounted on the second plate in a vertical direction. The key plate can be disposed in a space created by a first recess on a lower surface of the first plate and a second recess on an upper surface of the second plate in the cross sectional view of the first plate and the second plate, the second recess being aligned with the first recess in vertical direction, to fasten the first plate and the second plate together.

Alternatively, embodiments of the disclosed subject matter can involve an interconnection arrangement for a work machine. The interconnection arrangement for the work machine can comprise a first plate which is a part of the work machine and a key plate, the first plate being rotatable about a shaft of the work machine in a vertical direction and, the key plate having at least one top surface and at least one first contact surface as a slope surface in a cross sectional view of the key plate. The first plate and the key plate can be adapted to interface with another plate.

At least one of the first recess and the second recess is in the form of a trapezoidal shape in the cross sectional view of the first plate or the second plate, and the key plate can match a shape of the space created by the first recess and the second recess when the cab is in the first position and is provided in the first recess and the second recess when the cab is in the first position.

For instance, the second recess includes a bottom surface and a second contact surface as a slope surface in the cross sectional view of the second plate. Specifically, the first contact surface of the key plate can contact the second contact surface of the second recess when the cab is in the first position, in the cross sectional view of the second plate. Accordingly, a center point of the key plate can be aligned to at a center of the second recess by a guide formed by the first and the second contact surfaces.

By arranging the recesses on the contact surfaces of the two plates and positioning the key plate having the fittable shape into the space created by the recesses in the cross sectional view of the first plate and the second plate, the slope surfaces of the recesses and the slope surfaces of the key plate can become a guide to position the two plates in a proper position in a top plan view of the first plate and the second plate.

Optionally, the work machine can include a shaft that rotatably connects the cab riser to the main body, the cab riser being rotatable about the shaft in a clockwise direction and a counterclockwise direction to and from the first position and the second position. The key plate can be fastened to the first recess of the first plate by a fastening member, and the key plate can be movable in conjunction with the first plate during the cab riser being tilted from the second position to the first position. In that case, the first recess can be in the form of a rectangular shape in the cross sectional view, the first recess including a bottom surface and a third contact surface as a side surface, the third contact surface being orthogonal to the bottom surface in the cross sectional view. Accordingly, another first contact surface of the key plate can contact the third contact surface of the first recess when the cab is in the first position, in the cross sectional view of the first plate. That is, the lower surface of the first plate and the upper surface of the second plate can be directly or indirectly adjacent to each other in a state that the first plate and the second plate are fastened by the key plate.

As a result, it may be not necessary to attach and detach the key plate manually at each time of the transition to/from the transportation position of the cab riser from/to the operation position of the cab riser, and improves the usability of the work machine.

Optionally or alternatively, a first hole can be at the center of the key plate in a top plan view of the work machine, a second hole can be in the first plate, the second hole being aligned with the first hole in the top plan view, and a third hole can be in the second plate, the third hole being aligned with the first hole and the second hole in the top plan view. The fastening member can be inserted to the first hole, the second hole, and the third hole to fasten the first plate, the key plate, and the second plate together in the first position.

The holes and the fastening members (e.g., bolts, nuts, washers, screws, clamps etc.) to fix the two plates together can be arranged in different position in a top plan view of the work machine. By fastening the two plates by the fastening members and sandwiching the key plate between the two plates, the two plates can contact firmly without undesirable movement (e.g., rattling) in the right and left directions of the work machine.

Optionally, the two plates (the first plate and the second plate) can be clamped together by a clamping assembly in addition to coupling by the key plate, when the cab is in the first position. The clamping assembly can include two C-shaped clamps to clamp the first plate and the second plate at opposite edge portions of the first plate and the second plate in a longitudinal direction of the first plate and the second plate when the cab is in the first position.

Optionally or alternatively, the top surface of the key plate can have a square shape in a top plan view of the key plate, and a lower half of the key plate can be composed of the top surface and four first contact surfaces, each of the first contact surfaces being inclined in different directions to form a quadrangular pyramid shape. The upper half of the key plate can be an inverted shape of the lower half of the key plate.

Optionally or alternatively, the top surface of key plate can have a circle shape in a top plan view of the key plate, and a lower half of the key plate can be composed of the top surface and the first contact surface, the first contact surface being inclined to form a conical shape. The upper half of the key plate can be an inverted shape of the lower half of the key plate.

Optionally or alternatively, the key plate can be formed by shaving. Optionally or alternatively, the key plate can be formed as a part of the first plate in one piece, the first plate to be rotatable with respect to the second plate in a vertical direction.

According to the embodiments, the slope surfaces of the key plate can become a guide to align the two plates in a proper position in a top plan view of the work machine, when the cab riser is tilted uprightly on the main body. Furthermore, the key plate can reduce the lateral displacement of the two plates.

Furthermore, due to the key plate which can regulate the lateral displacement, even when bolts may be used as the fastening member to fix the two plates in the vertical direction, the shearing force applied to the bolts in the lateral direction can be reduced and damage of the bolts by the shearing force can be avoided. Therefore, according to the embodiments, it can provide a structure which prevents the shearing force from applying to the fastening member, in addition to facilitating positioning of parts of the cab riser and the main body of the work machine by guide during transition of the work machine from the transportation position to the operation position, while improving the material yield.

While aspects of the present disclosure have been particularly shown and described with reference to the embodiments above, it will be understood by those skilled in the art that various additional embodiments may be contemplated by the modification of the disclosed machines, assemblies, systems, and methods without departing from the spirit and scope of what is disclosed. Such embodiments should be understood to fall within the scope of the present disclosure as determined based upon the claims and any equivalents thereof.

The invention claimed is:

1. A work machine comprising:

a main body; and a cab riser including a cab and a frame, the cab being uprightly positioned on the work machine in a first position, and being tilted forward in a second position, and the frame comprising a first plate to contact a second plate provided on the main body in the first position;

wherein the first plate and the second plate are coupled together to sandwich a key plate when the cab is in the first position, the key plate being disposed in a space created by a first recess on a lower surface of the first plate and a second recess on an upper surface of the second plate in a cross sectional view of the first plate and the second plate, the second recess being aligned with the first recess vertically when the cab is in the first position, and wherein the key plate includes at least one first contact surface as a slope surface and at least one top surface, the top surface being adjacent to the slope surface and in parallel with the first plate or the second plate in a vertical direction, in the cross sectional view of the key plate.

2. The work machine according to claim 1, wherein at least one of the first recess and the second recess is in the form of a trapezoidal shape in the cross sectional view of the first plate or the second plate, and wherein the key plate matches a shape of the space created by the first recess and the second recess when the cab is in the first position and is provided in the first recess and the second recess when the cab is in the first position.

3. The work machine according to claim 2, wherein the second recess includes a bottom surface and a second contact surface as a slope surface in the cross sectional view of the second plate, and wherein the first contact surface of the key plate contacts the second contact surface of the second recess when the cab is in the first position, in the cross sectional view of the second plate.

4. The work machine according to claim 3, wherein a center point of the key plate is aligned to at a center of the second recess by a guide formed by the first and the second contact surfaces in a top plan view of the key plate.

5. The work machine according to claim 3, further comprising a shaft that rotatably connects the cab riser to the main body, the cab riser being rotatable about the shaft in a clockwise direction and a counterclockwise direction to and from the first position and the second position, wherein the key plate is fastened to the first recess of the first plate by a fastening member, and wherein the key plate is movable in conjunction with the first plate during the cab riser being tilted about the shaft from the second position to the first position.

6. The work machine according to claim 5, wherein the first recess is in the form of a rectangular shape in the cross sectional view of the first plate, the first recess including a bottom surface and a third contact surface as a side surface, the third contact surface being orthogonal to the bottom surface in the cross sectional view of the first plate, and wherein another first contact surface of the key plate contacts the third contact surface of the first recess when the cab is in the first position, in the cross sectional view of the first plate.

7. The work machine according to claim 5, wherein a first hole is at the center of the key plate in a top plan view of the work machine, wherein a second hole is in the first plate, the second hole being aligned with the first hole in a top plan view of the work machine, wherein a third hole is in the second plate, the third hole being aligned with the first hole and the second hole in the top plan view of the work machine, and wherein the fastening member is inserted to the first hole, the second hole, and the third hole to fasten the first plate, the key plate, and the second plate together when the cab is in the first position.

8. The work machine according to claim 5, wherein a fourth hole is arranged on the first plate, the fourth hole being disposed at a side of the key plate in the top plan view of the work machine, wherein a fifth hole is arranged on the second plate, the fifth hole being aligned with the fourth hole in the top plan view of the work machine, and wherein the fastening member extends through the fourth hole and the fifth hole to fasten the first plate and the second plate together when the cab is in the first position.

9. The work machine according to claim 5, wherein the fastening member includes a bolt, a nut, and a washer.

10. The work machine according to claim 1, wherein the first plate and the second plate are clamped together by a clamping assembly in addition to coupling by the key plate, when the cab is in the first position, and wherein the clamping assembly includes two C-shaped clamps to clamp the first plate and the second plate at opposite edge portions of the first plate and the second plate in a longitudinal direction of the first plate and the second plate when the cab is in the first position.

11. The work machine according to claim 1, wherein the top surface of the key plate has a square shape in a top plan view of the key plate, and wherein a lower half of the key plate is composed of the top surface and four first contact surfaces, each of the first contact surfaces being inclined in different directions to form a quadrangular pyramid shape.

12. The work machine according to claim 1, wherein the top surface of the key plate has a circle shape in a top plan view of the key plate, and wherein a lower half of the key plate is composed of the top surface and the first contact surface, the first contact surface being inclined to form a conical shape.

13. A method comprising:

providing a key plate for a work machine, the key plate having at least one top surface and at least one first contact surface as a slope surface in a cross sectional view of the key plate; and with the key plate non-fixedly resting in a second recess on an upper surface of a second plate of the work machine, providing the key plate between a first plate of the work machine and the second plate of the work machine, the first plate being a part of a cab riser of the work machine, the second plate being a part of a main body of the work machine, and the first plate being mounted on the second plate in a vertical direction with the key plate therebetween, wherein the key plate between the first plate of the cab riser and the second plate of the main body is in a space created by a first recess on a lower surface of the first plate and the second recess on the upper surface of the second plate in the cross sectional view of the first plate and the second plate, the second recess being aligned with the first recess in the vertical direction, to fasten the first plate and the second plate together with the key plate therebetween.

14. The method according to claim 13, further comprising:

forming the key plate by shaving.

15. The method according to claim 13, further comprising:

fastening the first plate to the second plate using one or more fastening members extending through the first plate and the second plate.

16. The method according to claim 13, further comprising:

fastening the key plate to at least one of the first plate or the second plate using a fastening member, the key plate being movable in conjunction with the at least one of the first plate or the second plate.

17. The method according to claim 13, further comprising:

fastening the first plate to the second plate using a fastener extending through the key plate.

18. An interconnection arrangement for a work machine, comprising:

a first plate which is part of the work machine, the first plate being rotatable about a shaft of the work machine to move downward in a vertical direction; and a key plate, the key plate having at least one top surface and at least one first contact surface as a slope surface in a cross sectional view of the key plate, wherein the first plate and the key plate are adapted to directly interface with a second plate in the vertical direction such that the key plate is between the first plate and the second plate and such that the first plate is above the second plate, and wherein the second plate is part of a main body of the work machine, and the first plate being movable downward in the vertical direction toward and to the second plate.

19. The interconnection arrangement according to claim 18, wherein the second plate is aligned to the first plate in the vertical direction, and wherein the key plate between the first plate and the second plate is in a space created by a first recess on a lower surface of the first plate and a second recess on an upper surface of the second plate in the cross sectional view of the first plate and the second plate, the second recess being aligned with the first recess in the vertical direction, to fasten the first plate and the second plate together with the key plate therebetween.

20. The interconnection arrangement according to claim 19, wherein the lower surface of the first plate and the upper surface of the second plate are directly adjacent to each other in a state that the first plate and the second plate are fastened by the key plate, or indirectly adjacent to each other by sandwiching another plate between the first and the second plates.

* * * * *